US006474985B1

(12) United States Patent
Miller et al.

(10) Patent No.: US 6,474,985 B1
(45) Date of Patent: Nov. 5, 2002

(54) TOOTHED GRATE FOR ROTARY KILN PERIPHERAL DISCHARGE OPENINGS

(75) Inventors: Samuel A. Miller, Danville, PA (US); Thomas H. Luepke, Jr., New Berlin, WI (US)

(73) Assignee: Metso Minerals Industries, Inc., Waukesha, WI (US)

( * ) Notice: Subject to any disclaimer, the term of this patent is extended or adjusted under 35 U.S.C. 154(b) by 0 days.

(21) Appl. No.: 10/124,910

(22) Filed: Apr. 17, 2002

(51) Int. Cl.[7] ..... F27B 7/32

(52) U.S. Cl. ..... 432/117; 432/103; 432/106; 432/118; 432/80

(58) Field of Search ..... 432/77, 78, 79, 432/80, 14, 106, 117, 118; 34/432

(56) References Cited

U.S. PATENT DOCUMENTS

| | | | | |
|---|---|---|---|---|
| 2,275,116 A | | 3/1942 | Vogel-Jorgensen | 34/25 |
| 2,859,955 A | | 11/1958 | Petersen | 263/32 |
| 2,970,828 A | | 2/1961 | Niems | 263/32 |
| 2,994,521 A | | 8/1961 | Azbe | 263/29 |
| 3,704,873 A | * | 12/1972 | Jensen | 34/135 |
| 3,824,069 A | * | 7/1974 | Brachthauser et al. | 432/80 |
| 3,918,891 A | * | 11/1975 | Theil | 432/18 |
| 4,123,850 A | | 11/1978 | Niems | 34/20 |
| 4,554,876 A | | 11/1985 | Grachtrup | 110/246 |
| 4,592,724 A | | 6/1986 | Dürr et al. | 432/78 |
| 4,626,202 A | | 12/1986 | Chisaki et al. | 432/107 |
| 4,680,009 A | | 7/1987 | Ernst et al. | 432/117 |
| 4,744,155 A | | 5/1988 | Niems | 34/57 |

* cited by examiner

*Primary Examiner*—Jiping Lu
(74) *Attorney, Agent, or Firm*—Andrus, Sceales, Starke & Sawall, LLP

(57) ABSTRACT

A rotary kiln for pyroprocessing particulate material includes a cylindrical kiln shell supported for rotation about a longitudinal central axis. The kiln has a plurality of circumferentially spaced peripheral openings provided in the kiln shell near its exit end for discharging pyroprocessed particulate material therethrough. A raised grate disposed over each discharge opening has a generally convex geometric profile that projects into the interior of said kiln shell.

22 Claims, 9 Drawing Sheets

TOOTHED GRATE FOR ROTARY KILN PERIPHERAL DISCHARGE OPENINGS

BACKGROUND OF THE INVENTION

The present invention relates to rotary kilns, and more particularly to a toothed grate for covering the peripheral discharge opening of a rotary kiln which utilizes satellite or planetary coolers.

A conventional rotary kiln comprises a simple cylinder or shell installed at an incline. Raw material feed to be pyroprocessed is charged into the kiln from an inlet at the elevated end, and thereafter the feed material is typically calcined by applying heat while the cylinder is rotated, and the calcined product is discharged from an outlet at the exit or lower end of the kiln. Kilns of this type are well known in the art and are capable of treating raw materials of many different kinds and a wide variety of particle sizes and shapes.

The hot pyroprocessed material exiting from the kiln is then typically cooled before further processing. Many different types of arrangements have been developed for cooling such material. One such arrangement is referred to as planetary or satellite coolers arranged circumferentially about the outside of the rotary kiln. When passing from the kiln to a peripheral cooler, pyroprocessed material exits the kiln via a plurality of circumferentially spaced peripheral discharge openings which in the past have been covered by a grate mounted horizontally within the discharge openings. The openings in the grates are sized to permit passage of a normal size range of product to the coolers and to reject oversized particles which could pass into the cooling unit and potentially act to plug the coolers and render them inoperable. In addition, the grates assure a quality product by segregating out the oversized particulate material which would otherwise render the product nonhomogeneous.

Although the use of grates has numerous advantages, as referred to above, grates also have numerous disadvantages. One disadvantage is that a grate which is located within the discharge opening actually reduces the area of the opening thus resulting in an increase in air velocity from the satellite coolers into the kiln than would be normal without the grates in the discharge openings. This relatively high velocity stream of air picks up or entrains fine material and carries it back into the interior of the kiln rather than allowing such material to discharge or exit from the kiln. Another disadvantage of grates that are located within the discharge openings is that since the grate reduces the area of the discharge opening, the rate of material discharge is also limited or reduced.

It is thus desirable to provide an arrangement at the discharge openings of a rotary kiln utilizing satellite or planetary coolers that would reduce or minimize the possibility of a flowback of fine material into the kiln as well as reduce or minimize the resistance to material discharge from the kiln caused by prior grates.

SUMMARY OF THE INVENTION

The present invention provides a raised grate disposed over each peripheral discharge opening of a rotary kiln that lead to peripheral or satellite coolers. The grate has a generally convex geometric profile that projects into the interior of the kiln, and is not in the plane of the peripheral discharge opening itself, as is prior art grates. The generally convex geometric profile or shape of the raised grate provides a greater open flow area than is provided by prior flat grates which were located in the plane of the peripheral discharge opening. The increased open areas available in the raised grate of the present invention are utilized in a counter flow fashion for the discharge of material from the kiln to peripheral or satellite coolers, and for the passage of cooling air exiting the peripheral or satellite coolers and entering the kiln via the discharge openings. Raising the grate so that it projects into the interior of the kiln increases the available area for countercurrent material and gas flow. This increase in available flow area of the discharge opening by not having the grate in the plane of the discharge opening, as well as the increased open area provided by the raised grate itself, reduces the velocity of the air entering the kiln from the tube cooler which in turn results in reduced dust entrainment in the air stream and therefore a reduced recirculating dust load within the interior of the kiln.

The edges of the grate that face the interior of the kiln are also lined with teeth. The rotary action of the kiln will bring the grate teeth into contact with agglomerated dust balls that form within the kiln. The repeated contact between the grate teeth and the dust balls that are too big to pass through the openings in the grate, will break pieces off the dust ball that are small enough to pass through the openings in the grate and enter the peripheral coolers. Thus, a relatively large dust ball is ultimately broken down such that it will completely pass through the grate and enter the peripheral cooler. The use of such teeth will eliminate the need to follow the prior art wherein a ring of lump breaker castings are installed at the discharge end of the kiln. In addition, the prior art lump breaker castings can be replaced by a refractory discharge dam at the exit end of the kiln that will keep the dust balls in contact with the toothed raised grate and directs the crumbled dust ball to pass through the openings in the tooth raised grate, through the discharged opening in the kiln and into the peripheral coolers along with the main product stream. Prior art lump breaker castings on the kiln exit end have the disadvantage of sometimes allowing crumbled dust balls to discharge from the kiln end and thereby bypassing the peripheral coolers and being separated from the main product stream. The use of a toothed raised grate together with a discharge dam will minimize any product bypassing the main product stream and will assure a quality product of substantially similar sized particulate material.

In accordance with the present invention, the toothed raised grate comprises a grid portion, a plurality of feet spaced from and extending substantially parallel to the grid portion, and a plurality of legs interconnecting the grid portion and feet. The grid portion, feet and legs are integrally formed of a plurality of spaced lengthwise extending bars and a plurality of crosswise extending bars so as to have a generally convex or "spider-like" geometric profile. Both the grid portion and legs preferably include teeth projecting therefrom.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
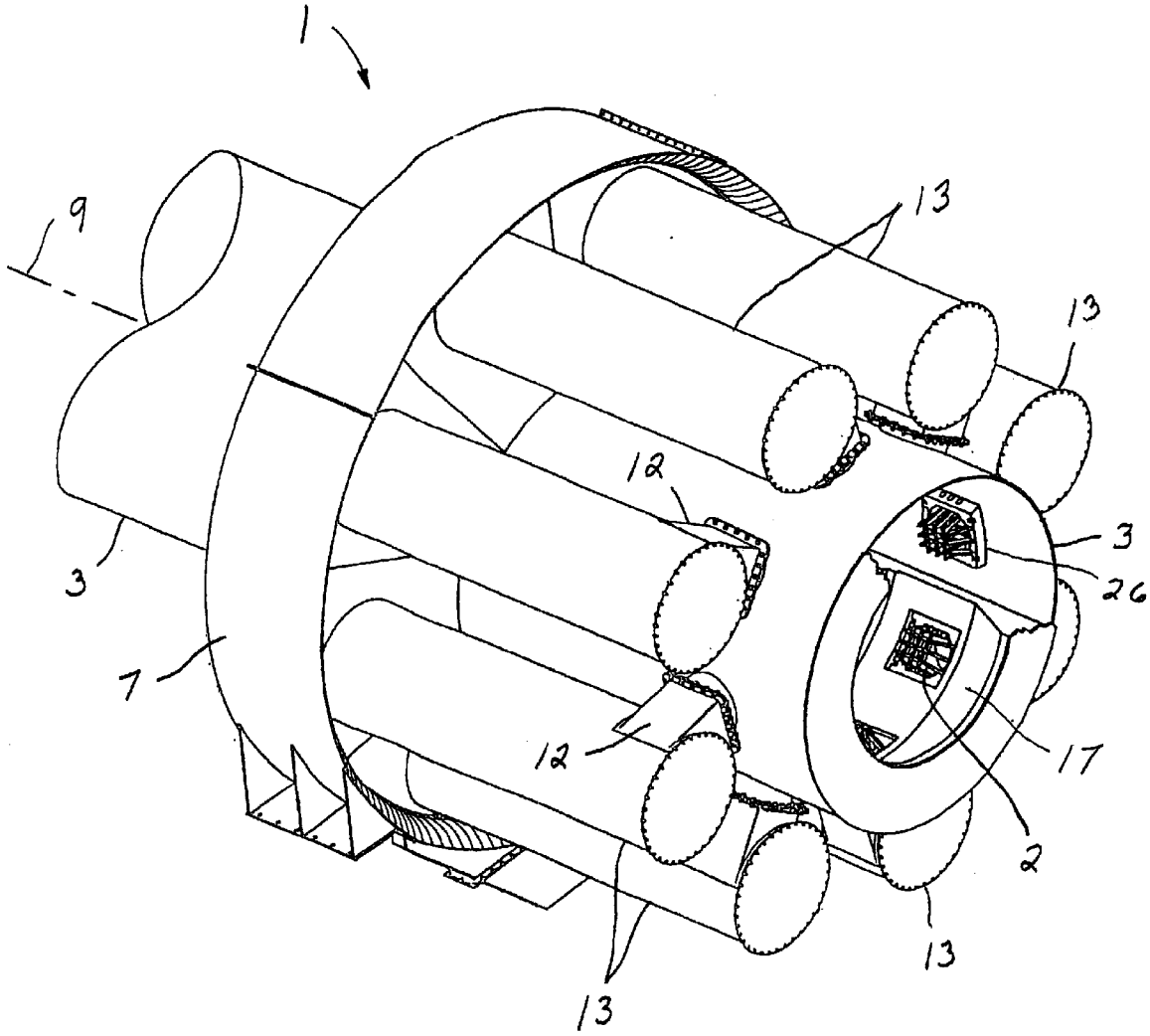
FIG. 1 is a schematic perspective view of a rotary kiln incorporating the raised grate of the present invention.
Figure 2:
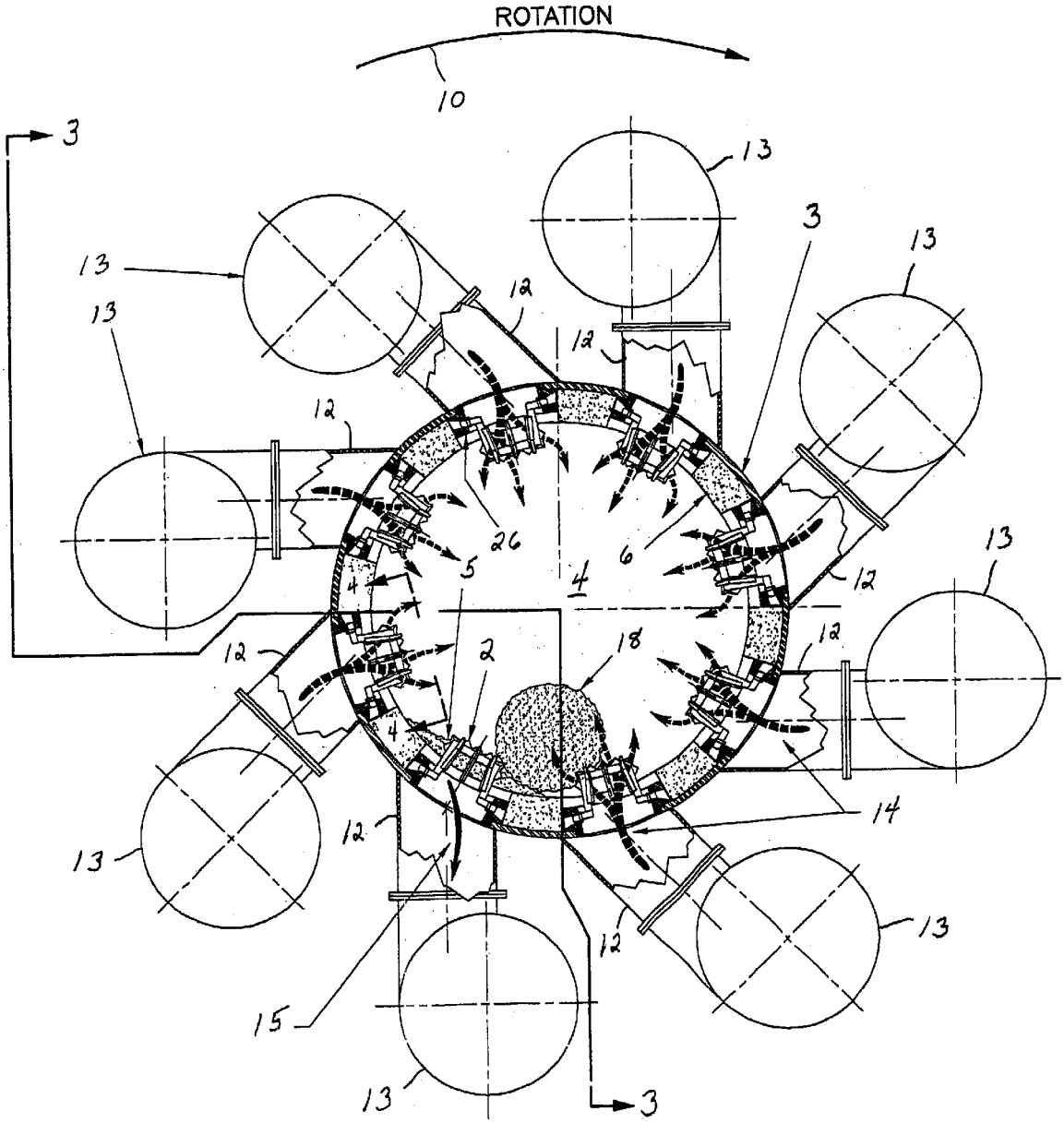
FIG. 2 is an end view of the rotary kiln and coolers taken along the plane of the line 2—2 in FIG. 3.
Figure 3:
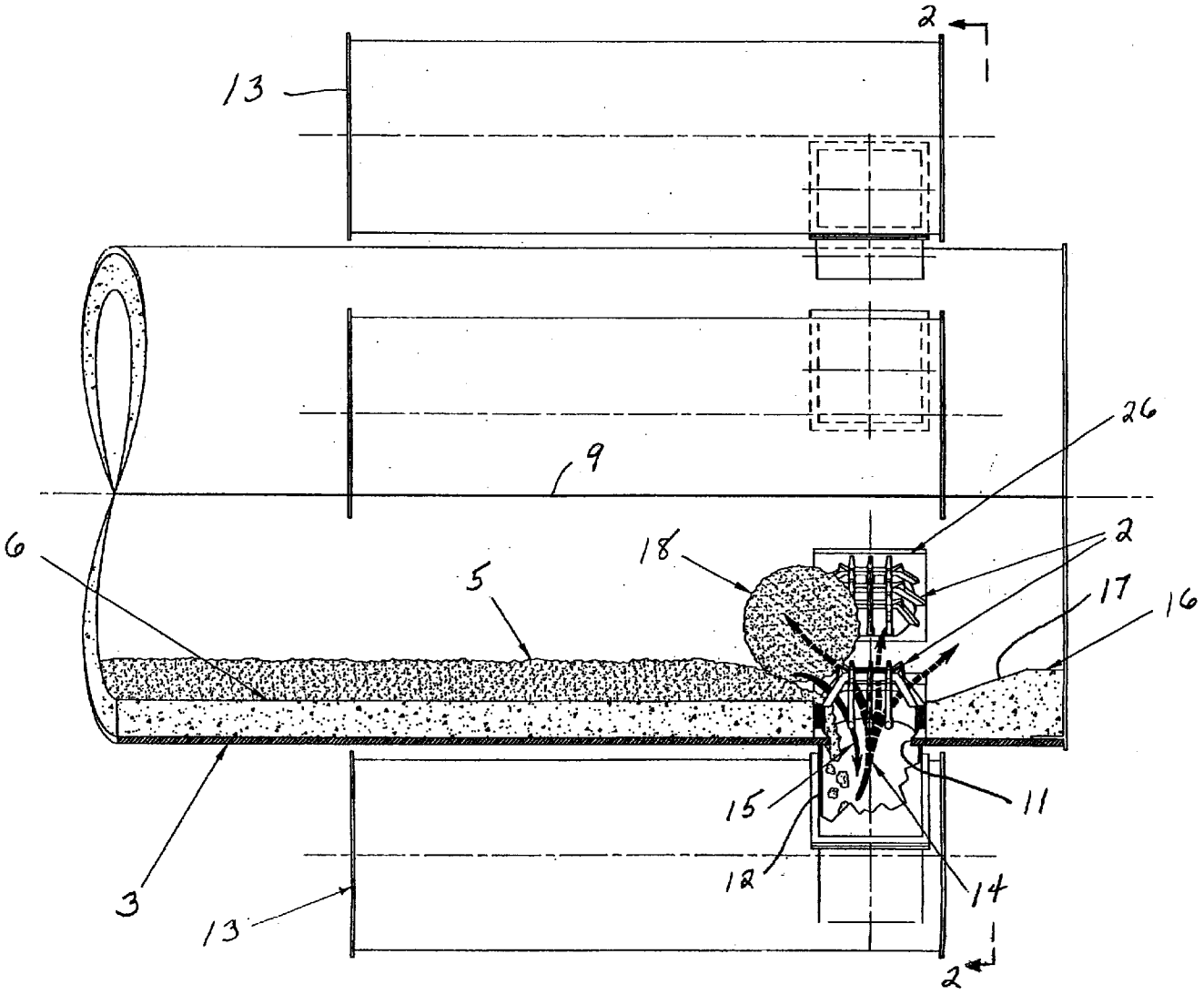
FIG. 3 is a cross-sectional side view in elevation of the rotary kiln taken along the plane of the line 3—3 in FIG. 2.

Referring now to the drawings, FIGS. 1–3 schematically illustrate a rotary kiln generally designated by the numeral 1 which incorporates a raised grate assembly 2 constructed in accordance with the present invention. In the present embodiment, the rotary kiln 1 may be used for the recovery of lime from lime sludge generated in the pulp and paper industry. Basically, in lime recovery, lime containing sludge is calcined or pyroprocessed to drive off carbon dioxide leaving calcium oxide in the form of lime pebbles are particles. A lime recovery kiln such as that illustrated in FIGS. 1–3 is typically part of a system that may incorporate agglomeraters, dryers, pelletizers and the like to prepare particulate material that is introduced as feed stock into one end thereof Since there are numerous uses for rotary kilns, the use of terms such as "calcining" and/or "pyroprocessing" is not meant to be limiting and in fact refers to only one example of the many potential uses for kiln 1 with which the raised grate 2 of the present invention may be incorporated.

The present invention is thus directed to apparatus for pyroprocessing of particulate materials which is here exemplified by calcined lime pebbles such as are produced from lime sludge which is heat processed in the kiln. The present invention is not limited to processing of lime pebbles alone, however, since it may be applied to other heat processed particles of matter such as dolomite, cement, clay, shale and the like. The term "particles" and/or "particulate material" as used herein refers to the many forms of such material including large and small pieces, pebbles, pellets, granules, broken solids, fragments, clinkers, and the like. In this regard, lime particles processed in rotary kiln 1 may, for example, typically range in size from dust less than 60 mesh to particulate material of about 2 inches in diameter.

As illustrated, rotary kiln 1 comprises an elongated cylindrical body or shell 3 which defines a cylindrical combustion chamber 4 for pyroprocessing of the feed, which is schematically illustrated in FIG. 3 as material bed 5. The general arrangement and construction of rotary kilns of this type are well known to those skilled in the art and thus need not be described in detail. The shell or inner wall 3 of kiln 1 may be lined with any suitable refractory material such as fire bricks 6. Any well known means (not shown) may be provided for supporting and rotating kiln 1. A motor (not shown) rotates kiln 1 about its central longitudinal axis 9 in a clockwise direction as illustrated by arrow 10 in FIG. 2. A charge of raw material to be processed is fed into the upstream or inlet end of kiln 1, and since kiln 1 is inclined with respect to a horizontal plane downwardly toward its exit end, i.e. from left to right shown in FIGS. 1 and 3, the raw material 5 to be pyroprocessed slowly travels by gravity through the combustion chamber 4 as the cylindrical body or shell 3 rotates. At the same time, heat is introduced into the combustion chamber 4 through a burner (not shown) to heat the kiln 1 and feed material 5 to be pyroprocessed. The material 5 continues to proceed downstream at a predetermined feed rate until it reaches a plurality of circumferentially spaced peripheral discharge openings 11 formed near the exit end of kiln 1. The hot material 5 then exits or falls through the discharge openings 11 into a duct 12 which leads to a tube cooler 13, which in turn leads to a stationary discharge housing 7. As illustrated in FIGS. 1 and 2, there are eight tube coolers 13 disposed around the periphery of kiln 1. A greater or lesser number of coolers 13 could be utilized depending upon the application, and the arrangement illustrated in FIGS. 1 and 2 for cooling the pyroprocessed material is typically referred to as a planetary or satellite cooling system for which the present raised grate 2 is particularly adapted. Pyroprocessed material is received continuously in coolers 13 directly from kiln 1 where it resides for a period of time to provide the necessary heat transfer from the hot particulate pyroprocessed material to cooling air passing therethrough. The cooling air is introduced into the hot particulate material exiting kiln 1 to affect counter flow cooling. To promote maximum efficiency in the overall system in which the kiln 1 and tube coolers 13 are incorporated, the heat extracted from the particulate matter by the cooled air is typically returned to the combustion chamber 4 as preheated air for combustion. Since the kiln 1 utilizing planetary or satellite coolers 13 of this type is well known in the art and forms no part of the present invention, it is not illustrated or described in detail herein. The counter current flow of cooling air is schematically illustrated in FIGS. 2 and 3 via arrows 14 while the direction of material exiting kiln 1 through discharge openings 11 is illustrated by the arrows 15 in FIGS. 2 and 3.

As seen best in FIGS. 1 and 3, a discharge dam 16 composed of refractory material is located at the exit end of kiln 1. Discharge dam 16 comprises refractory material having an inclined surface 17 that will keep large particulate material such as dust balls 18 in contact with the raised grate 2, as will hereinafter be described so that dust balls 18 eventually are broken up into smaller particulate material which may pass through the openings in the raised grate 2, through the discharge opening 11 and into a tube cooler 13 along with the main product stream. Dam 16 eliminates the need to follow the prior art of installing a ring of lump breaker castings at the discharge or exit end of the kiln 1. The use of prior art lump breaker castings on the kiln discharge or exit end, without the benefit of a discharge dam, allows broken particles from the dust balls to discharge from the open exit end of kiln 1 thereby bypassing the tube coolers 13 and being separated from the main product stream. Such undesirable results is minimized and/or eliminated via the use of dam 16 and raised grates 2, as will hereinafter be described.

As seen best in FIGS. 1–3, particulate material 5 being discharged through openings 11 must first pass through the raised grate 2. Grate 2 allows for the normal size range of product and rejects oversized pieces such as dust balls 18 or other random oversized particles. The grates 2 are made of heat-resistant material such as cast iron or stainless steel to withstand the high temperature of the preheated air and the hot discharging material flowing from kiln 1. Without grates 2, the oversized pieces would pass into coolers 13 and act to block or plug downstream regions thereof, and could thus render coolers 13 inoperable. In addition, the grate 2 assures a quality product by segregating out the oversized particulate material which would otherwise render the product relatively nonhomogeneous.

Figure 5:
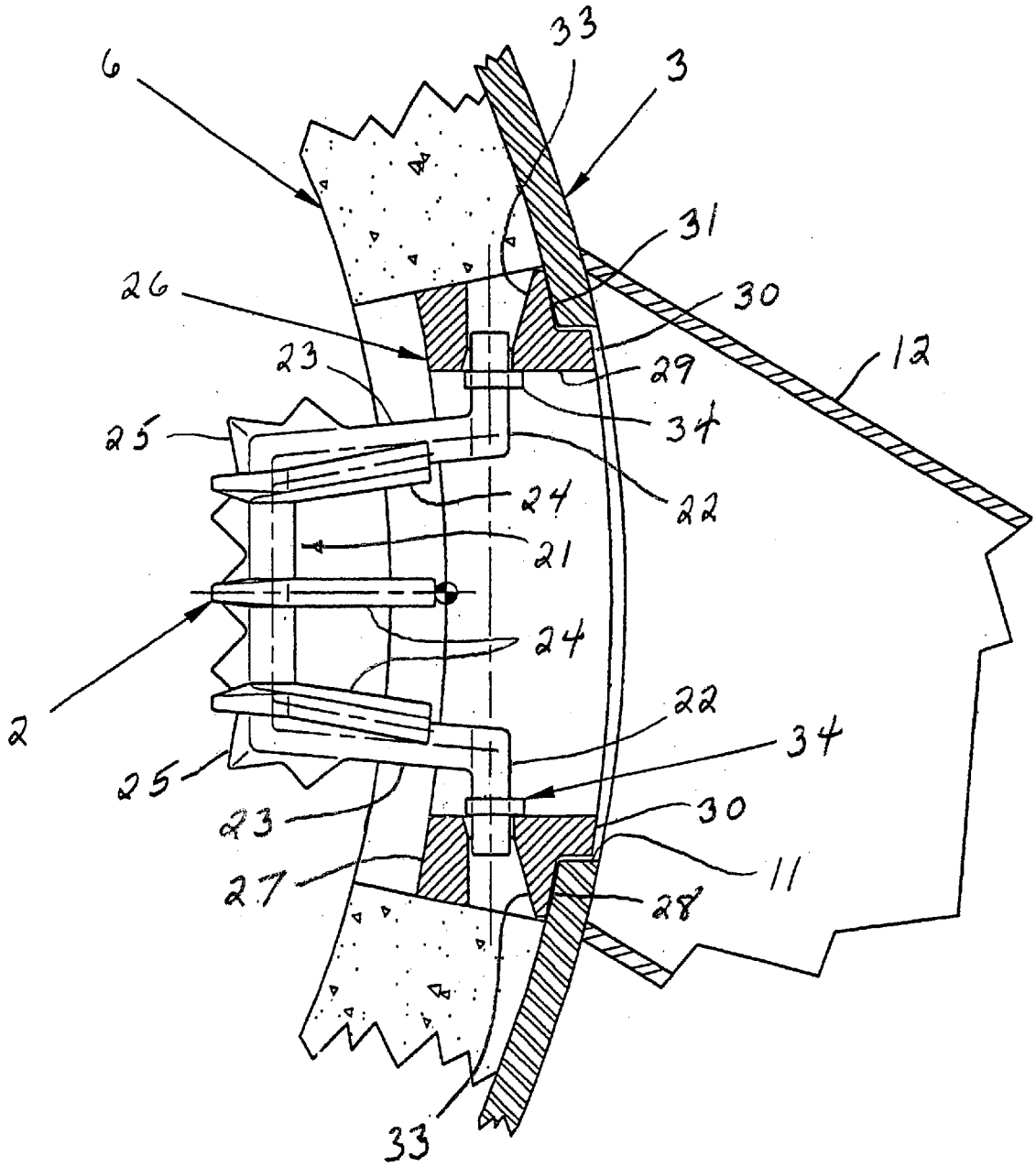
FIG. 5 is a cross-sectional view of the grate assembly taken along the plane of the line 5—5 in FIG. 4.
Figure 6:
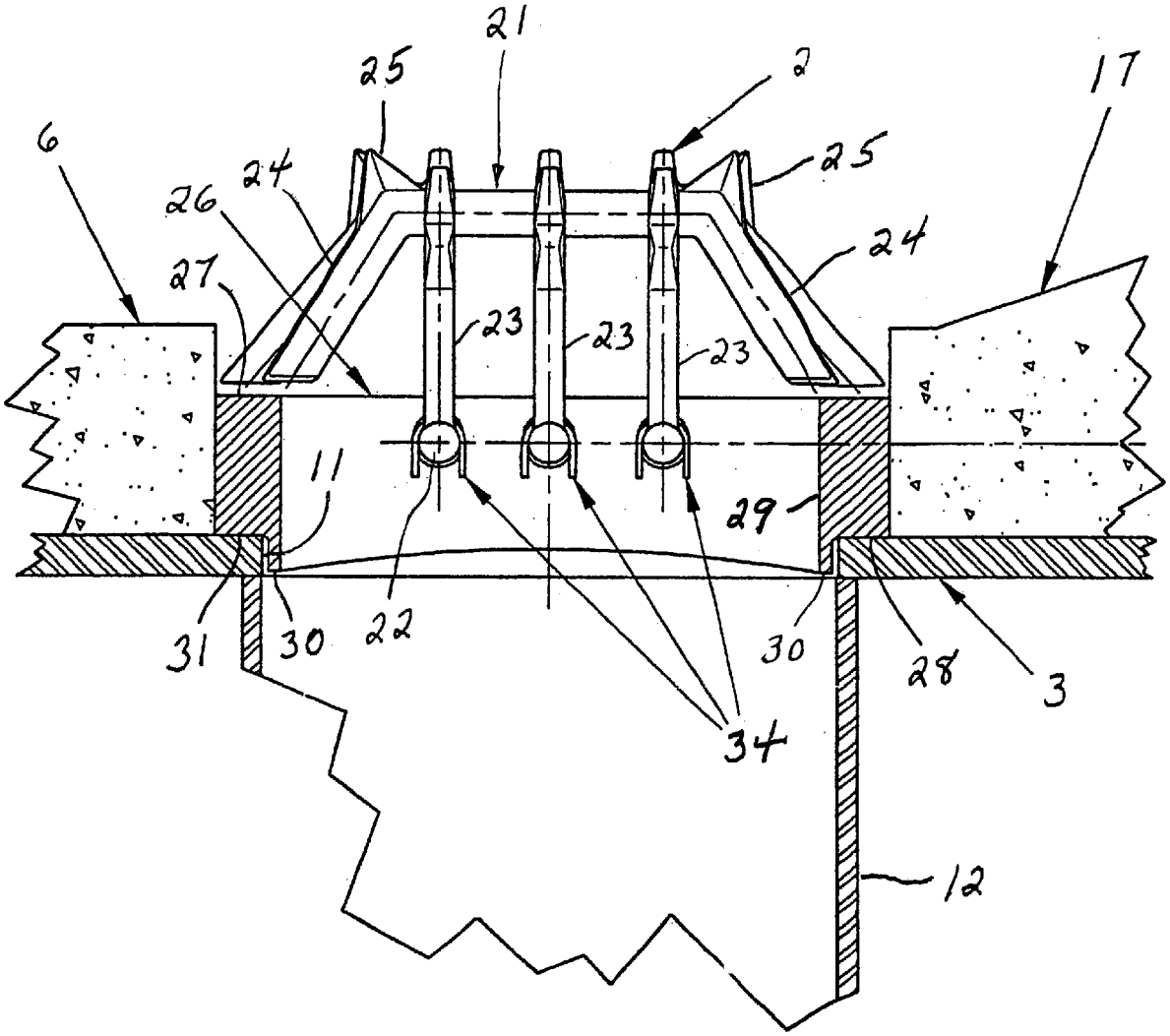
FIG. 6 is a cross-sectional view of the grate assembly taken along the plane of the line 6—6 in FIG. 4.
Figure 7:
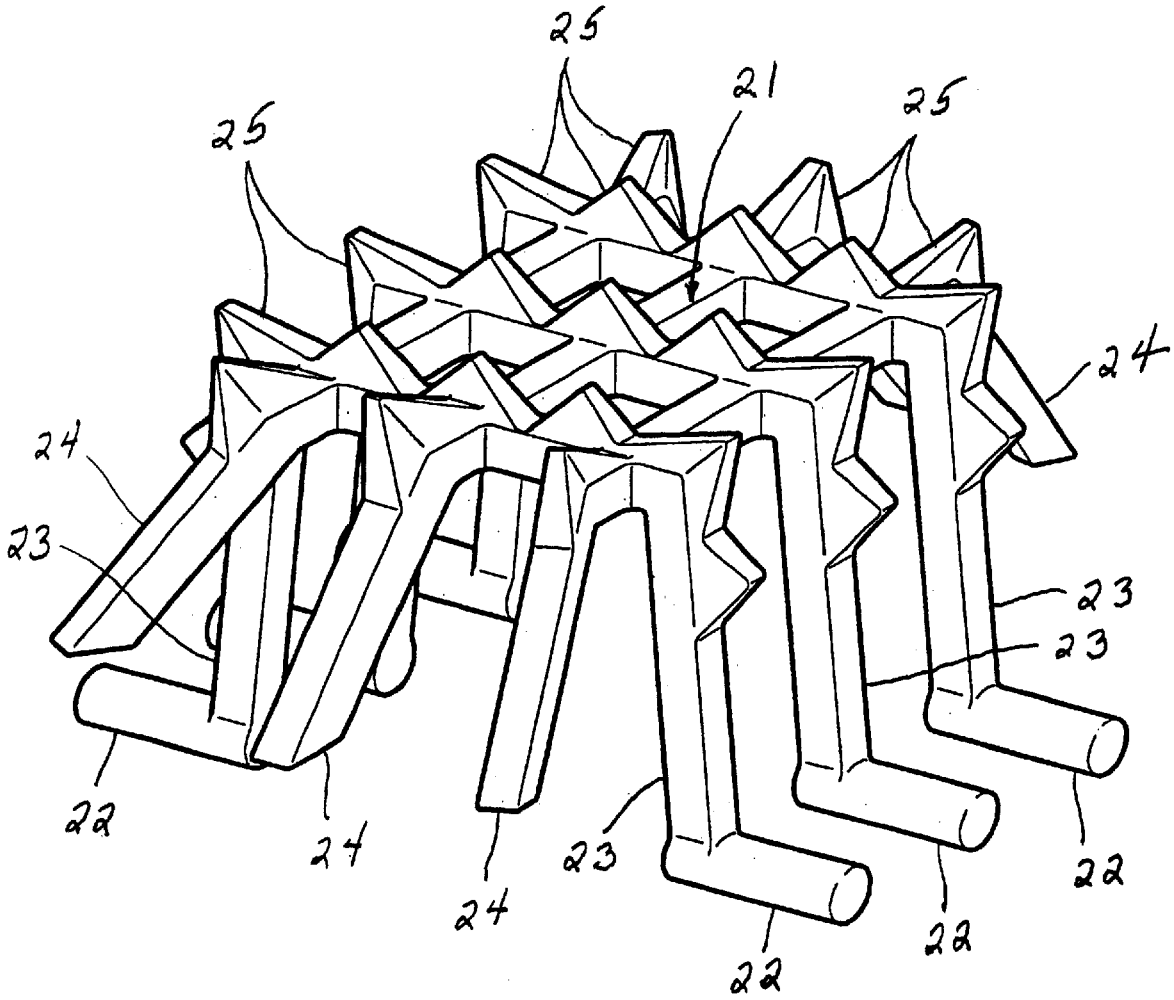
FIG. 7 is a perspective view of the raised grate.

As shown best in FIGS. 5–7, raised grate 2 has a generally convex-shaped geometric profile. Raised grate 2 due to its convex geometric profile, is raised above and projects into the interior of kiln 1 and is thus not in the plane of the discharge opening 11, as are prior art grates. By "generally convex-shaped geometric profile," it is meant that raised grate 2 is generally in the form of a truncated cone. However, other designs are possible, such as dome-shaped and/or polygonal-shaped. In other words, looking at grate 2 in cross-section, it could be hemispherical, two-sided (pyramid-shaped), three-sided (i.e. truncated cone), four-sided, five-sided, six-sided or any other polygonal shape, as long as the apex of the raised grate 2 projects into the interior of kiln 1. The apex of grate 2 preferably projects past the inner surface of the refractory fire bricks 6 as best seen in FIGS. 2 and 3. The convex shape of raised grate 2 provides a greater open flow area than is provided by prior art flat grates which are located in the plane of the discharge openings. Raising the grate 2 above the plane of discharge opening 11 increases the available area for discharging material from the interior of kiln 1 as well as increases the available area for countercurrent air flow passing from coolers 13 into the interior of kiln 1. The convex geometry of raised grate 2 thus increases the open flow area of grate 2, and this increase in available flow area results in two advantages. First, by not disposing grate 2 in the plane of discharge opening 11 and by increasing the open area provided by grate 2, the velocity of the cooling air entering kiln 1 from coolers 13 are reduced which results in reduced dust entrainment in the air stream 14 and therefore a reduced recirculating dust load in kiln 1. Secondly, the increased open flow area of grate 2 results in a more uniform rate of discharge of material 5 from kiln 1 into coolers 13.

Figure 8:
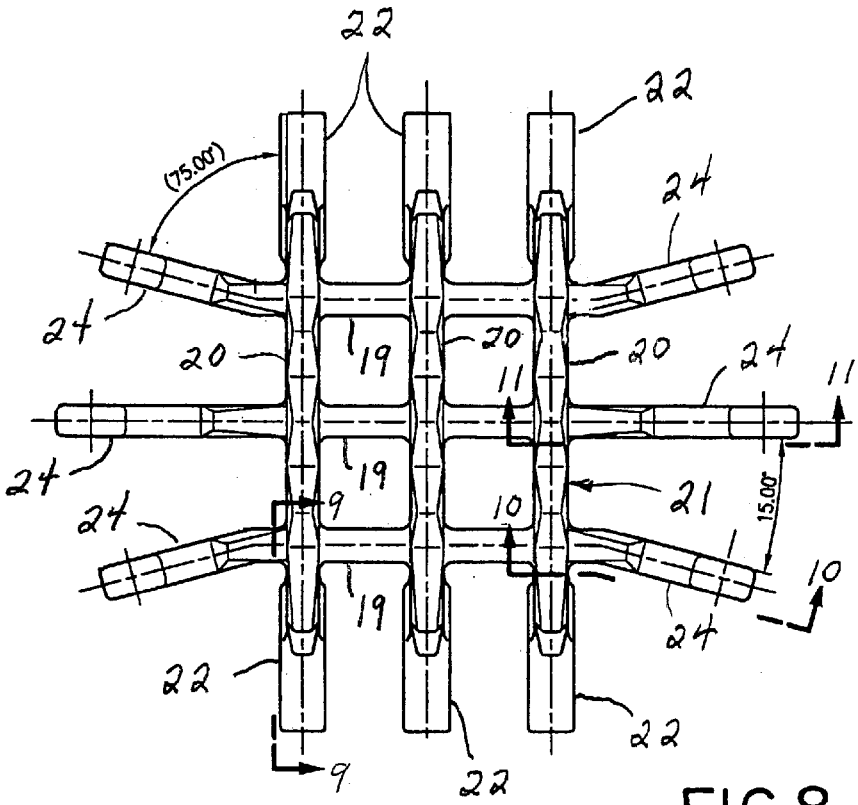
FIG. 8 is a top view of the raised grate.
Figure 9:
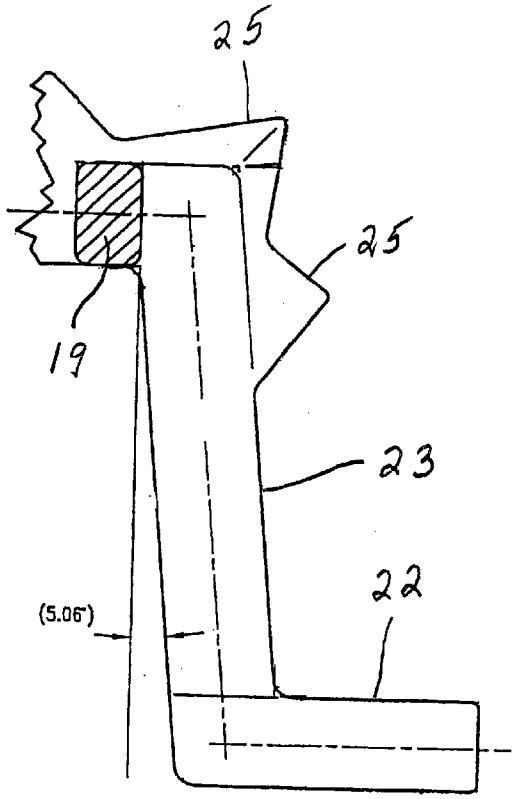
FIG. 9 is a cross-sectional view of one of the legs of the raised grate taken along the plane of the line 9—9 in FIG. 8.
Figure 10:
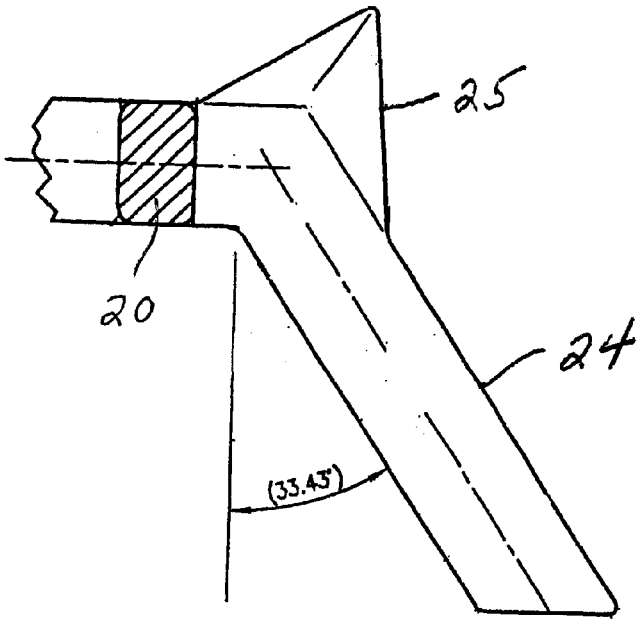
FIG. 10 is a cross-sectional view of another leg of the raised grate taken along the plane of the line 10—10 in FIG. 8.
Figure 11:
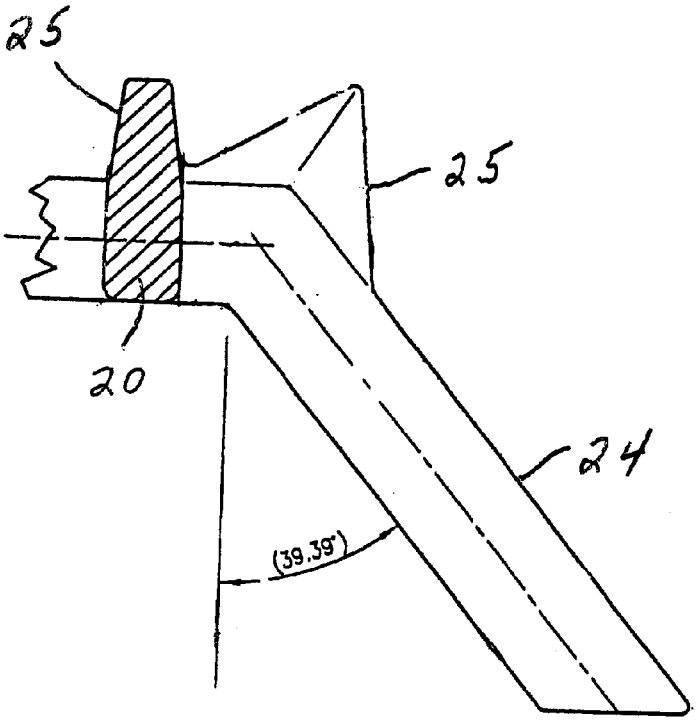
FIG. 11 is a cross-sectional view of still another leg of the raised grate taken along the plane of the line 11—11 in FIG. 8.

As shown best in FIG. 7, raised grate 2 is comprised of a plurality of spaced longitudinally extending bars 19, and a plurality of spaced crosswise extending bars 20, which as noted above, are cast in a generally convex geometric profile which takes on a "spider-like" appearance (see FIG. 7). As noted, the longitudinally extending bars 19 and crosswise extending bars 20 are integrally formed in one piece as a casting made from iron or stainless steel. As shown, raised grate 2 includes a grid portion 21 having rectangular-shaped interstices, a plurality of feet 22 spaced below grid portion 21 and extending parallel thereto, and a plurality of downwardly extending and outwardly inclined crosswise extending legs 23 interconnecting crosswise bars 20 with feet 22. Grate 2 further includes a plurality of lengthwise legs 24 integral with longitudinally extending bars 19 which also project downwardly and are outwardly inclined from the ends of bars 19. As shown best in FIG. 9, crosswise legs 23 are disposed at an acute angle of respective grid portion 21 with the acute angle being approximately 5°. As shown best in FIG. 10, the outer lengthwise leg 24 is also located at an acute angle with respect to grid portion 21 with its angle being approximately 33°. Finally, the middle lengthwise leg 24 is illustrated in FIG. 11 and projects at an acute angle with respect to grid portion 21 with its acute angle being approximately 39°. Likewise, as seen best in FIG. 8, the outer lengthwise legs 24 are not parallel with middle legs 24 but instead are cast at a slight angle of about 15° thereto.

The edges of bars 19 and 20 that face the interior of kiln 1 are lined with teeth 25. The rotary action of kiln 1 will bring grate teeth 25 into contact with large particulate material such as dust balls 18 that agglomerate within kiln 1. Dust balls 18 are too large to pass through the openings in grate 2, but as kiln 1 rotates, grate teeth 25 are brought into contact with dust balls 18 and will break pieces or particles off of dust ball 18 that are small enough to pass through the openings in grate 2 and enter tube cooler 13. As a result, dust ball 18 will ultimately by broken down to relatively smaller pieces which will enable it to completely pass through the raised grate 2 and enter coolers 13.

Figure 4:
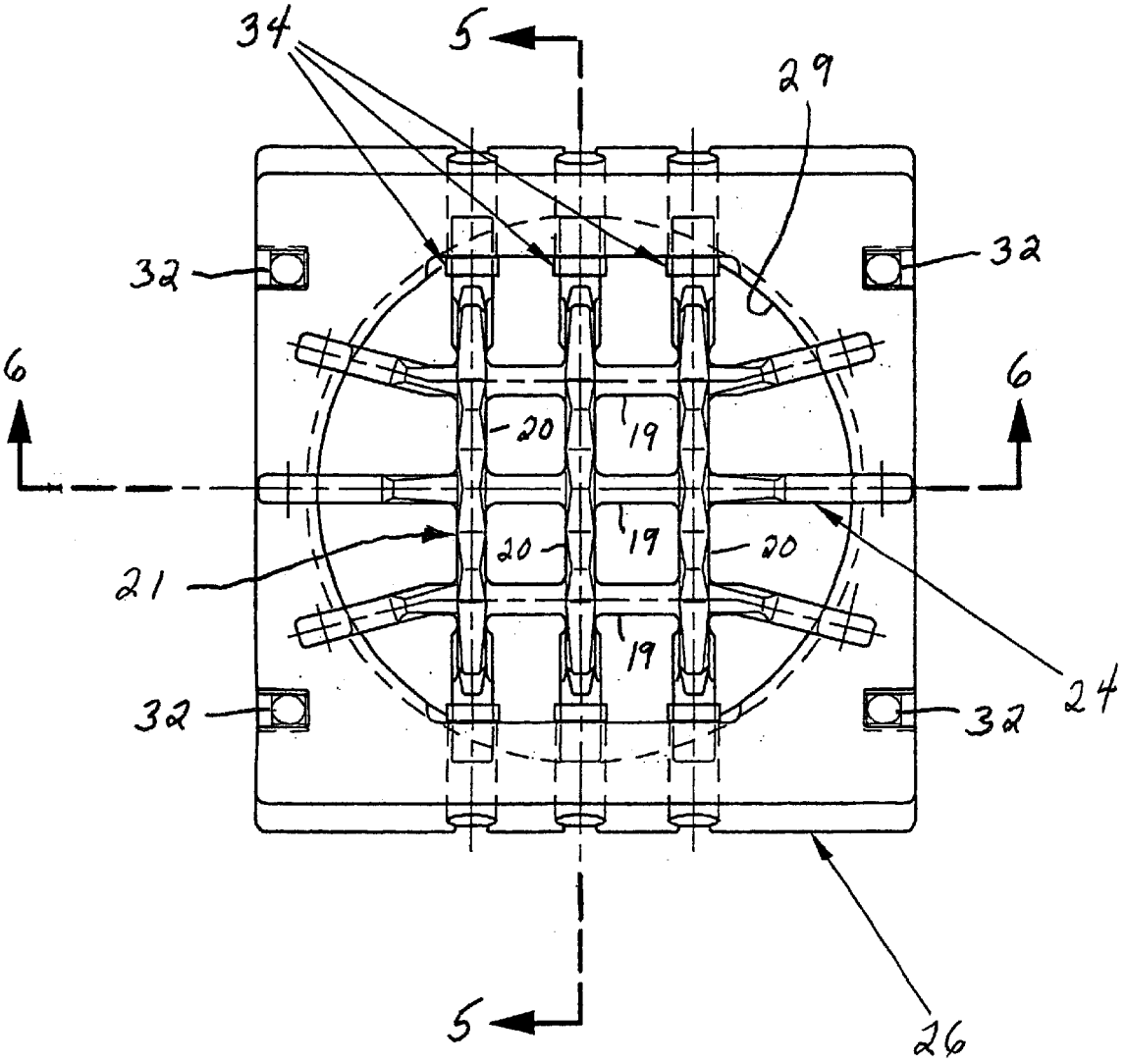
FIG. 4 is a top view of one of the grate assemblies taken along the plane of the line 4—4 in FIG. 2.

As shown best in FIGS. 4–6, raised grate 2 is mounted within a support casting 26 which in turn is mounted around discharge opening 11. As illustrated, support casting 26 is comprised of iron or stainless steel and is substantially rectangular in shape, (see FIG. 4) having an inner side 27 which faces the interior of kiln 1 and an opposite outer side 28. A central substantially cylindrically-shaped port 29 is formed through casting 26, and when casting 26 is assembled on shell 3, port 29 is coincident with discharge opening 11. As seen best in FIGS. 5 and 6, the outer side 28 of casting 26 includes a lip 30 projecting outwardly therefrom which forms a seat 31 on the outer side 28 of casting 26. The geometry of lip 30 matches the geometry of discharge opening 11 such that casting 26 may be mounted on shell 3 such that lip 30 is received within discharge opening 11 and seat 31 bears against the inner surface of shell 3. As shown in FIG. 4, support casting 26 is fixed in position by four bolts 32 passing through the body of casting 26 into shell 3.

As shown best in FIG. 5, support casting 26 includes a plurality of bores 33 formed substantially radially into the inner surface of port 29. Bores 33 receive feet 22 of grate 2 and are thus dimensioned to substantially correspond with the diameter and shape of feet 22. In order to secure grate 2 in position, a plurality of clips 34 are positioned on feet 22. As seen best in FIG. 6, crosswise legs 23 of grate 2 are slightly longer than lengthwise legs 24 thus resulting in legs 24 being in close proximity to the inner side 27 of support casting 26 while feet 22 are inserted into and supported by bores 33 of support casting 26.

To perform calcination by means of the rotary kiln 1 having the foregoing raised grate 2, kiln 1 is set into rotation, and the raw material is charged at a predetermined feed rate into the calcination chamber 4. The material is heated uniformly while tumbling through the interior of combustion chamber 4 until it reaches discharge openings 11 where it passes through raised grate 2 into coolers 13. Any large particulate material is broken up by the teeth 25 on grate 2 and is prevented from bypassing the coolers 13 by means of discharge dam 16. The calcined material falling into coolers 13 then proceeds downstream to be processed into a final product.

I claim:

1. A rotary kiln for pyroprocessing particulate material, comprising:

a cylindrical kiln shell supported for rotation about a longitudinal central axis, said kiln shell having a material inlet end and a material exit end and being inclined with respect to said horizontal plane downwardly toward said exit end enabling particulate material to be pyroprocessed within its interior as said kiln shell rotates;

a plurality of circumferentially spaced peripheral openings provided in the kiln shell near said exit end for discharging pyroprocessed particulate material therethrough before reaching said exit end; and a raised grate disposed over each discharge opening, said grate having a generally convex geometric profile that projects into the interior of said kiln shell.

2. The rotary kiln of claim 1 wherein said raised grate comprises a plurality of spaced lengthwise extending bars and a plurality of spaced crosswise extending bars.

3. The rotary kiln of claim 2 wherein said profile comprises a truncated cone.

4. The rotary kiln of claim 2 wherein said raised grate comprises a grid portion disposed within said kiln shell, a plurality of feet affixed to said kiln shell, and a plurality of legs interconnecting said grid portion and said feet.

5. The rotary kiln of claim 4 wherein said grid portion further includes teeth projecting therefrom.

6. The rotary kiln of claim 4 wherein said legs further include teeth projecting therefrom.

7. The rotary kiln of claim 1 further including a grate support disposed at each of said discharge openings for mounting said raised grate, and fastening means for fastening said grate support to said kiln shell.

8. The rotary kiln of claim 7 wherein said raised grate includes a plurality of feet and said grate support includes a plurality of corresponding feet-receiving bores formed therein.

9. The rotary kiln of claim 8 further including retainer means for retaining said feet within said feet-receiving bores.

10. A grate assembly for covering a peripheral discharge opening provided in a rotary kiln shell, comprising:

a grate support having a body portion with an inner side, an outer side and a port formed therethrough defining a central axis, and a lip projecting from the outer side of said body portion coincident with said central axis to define a seat on the outer side of said body portion whereby said seat engages a rotary kiln shell when said lip is received within a peripheral discharge opening provided in the rotary kiln shell; and a raised grate covering said port, said grate having a generally convex geometric profile that projects beyond the inner side of said grate support.

11. The grate assembly of claim 10 wherein said raised grate comprises a plurality of spaced lengthwise extending bars and a plurality of spaced crosswise extending bars.

12. The grate assembly of claim 11 wherein said profile comprises a truncated cone.

13. The grate assembly of claim 11 wherein said raised grate comprises a grid portion disposed above said inner side, a plurality of feet affixed to said grate support, and a plurality of legs interconnecting said grid portion and said feet.

14. The grate assembly of claim 13 wherein said grid portion further includes teeth projecting therefrom.

15. The grate assembly of claim 13 wherein said legs further include teeth projecting therefrom.

16. The grate assembly of claim 10 wherein said raised grate includes a plurality of feet and said grate support includes a plurality of corresponding feet-receiving bores formed therein.

17. The grate support of claim 16 further including retainer means for retaining said feet within said feet-receiving bores.

18. A grate for covering a peripheral discharge opening provided in a rotary kiln shell, comprising:

a grid portion;

a plurality of feet spaced from and extending substantially parallel to said grid portion;

a plurality of legs interconnecting said grid portion and said feet;

said grid portion feet and legs being integrally formed of a plurality of spaced lengthwise extending bars and a plurality of crosswise extending bars so as to have a generally convex geometric profile.

19. The grate of claim 18 wherein said grid portion is substantially planar in shape, and said legs extend downwardly and outwardly therefrom at an acute angle thereto.

20. The grate of claim 19 wherein said profile comprises a truncated cone.

21. The grate of claim 18 wherein said grid portion further includes teeth projecting therefrom.

22. The grate of claim 18 wherein said legs further include teeth projecting therefrom.

* * * * *